US006732698B1

(12) United States Patent
Bedwell et al.

(10) Patent No.: US 6,732,698 B1
(45) Date of Patent: May 11, 2004

(54) AUSTEMPERED GRAY IRON CYLINDER LINER AND METHOD OF MANUFACTURE

(75) Inventors: Tommy J. Bedwell, Ann Arbor, MI (US); John F. Miller, Red Wing, MN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 500 days.

(21) Appl. No.: 09/688,676

(22) Filed: Oct. 16, 2000

Related U.S. Application Data

(60) Provisional application No. 60/215,625, filed on Jun. 30, 2000.

(51) Int. Cl.[7] ..... C21D 5/00

(52) U.S. Cl. ..... 123/193.2; 148/612

(58) Field of Search ..... 123/193.2; 148/321, 148/612

(56) References Cited

U.S. PATENT DOCUMENTS 5,104,458 A * 4/1992 Sundstedt et al. ..... 148/3

* cited by examiner

*Primary Examiner*—Marguerite McMahon
(74) *Attorney, Agent, or Firm*—Reising, Ethington, Barnes, Kisselle, Learman & McCulloch, P.C.

(57) ABSTRACT

A cylinder liner for high temperature, high performance engine applications is cast from gray iron material and thereafter austempered for a time sufficient to achieve a substantially bainitic microstructure that is stable against excessive thermal growth when the liner is exposed to extreme operating temperatures of about 450° F. for an extended period of time of about 20 hours.

11 Claims, 3 Drawing Sheets

FIG-1
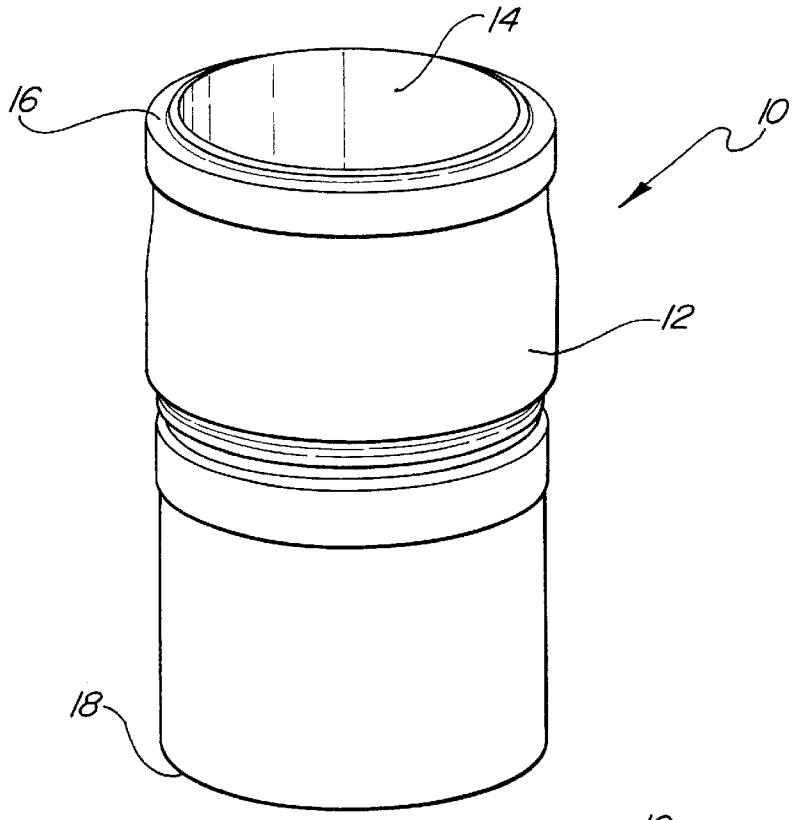
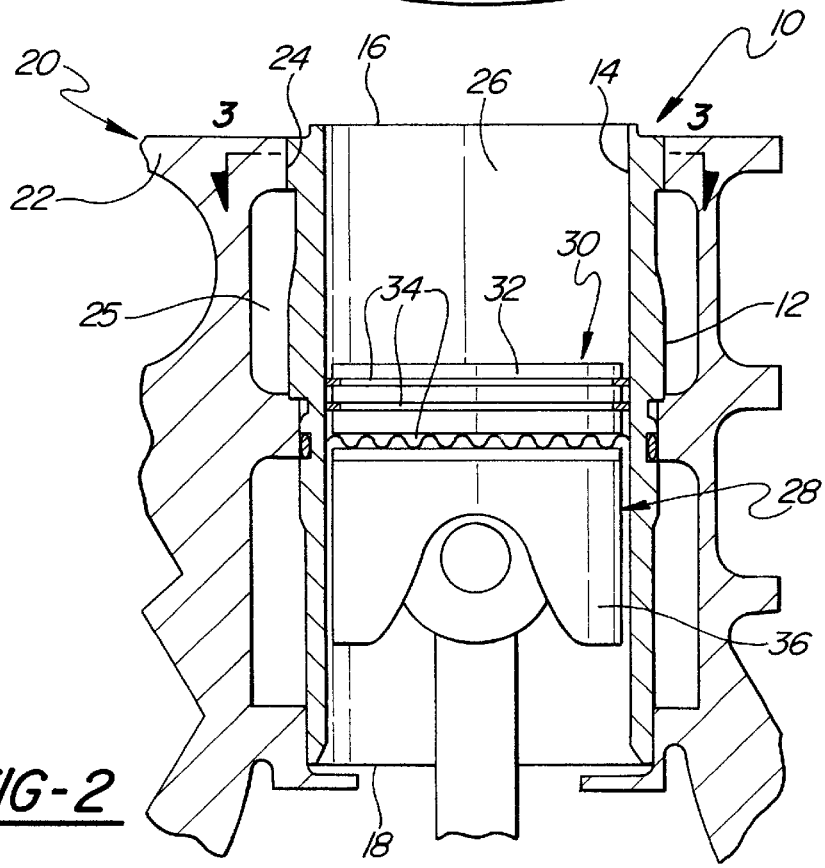
FIG-2

AUSTEMPERED GRAY IRON CYLINDER LINER AND METHOD OF MANUFACTURE

This disclosure incorporates the austempered gray iron cylinder liner and method of manufacture disclosed in provisional patent application Ser. No. 60/215,625, filed Jun. 30, 2000, whose priority is claimed for this application.

BACKGROUND OF THE INVENTION

1. Technical Field

This invention relates to cylinder liners for use in internal combustion engine applications.

2. Related Prior Art

Cylinder liners are often employed in heavy duty diesel engine applications to line the bores of the engine block, in which the pistons reciprocate. The liners are often made of gray cast iron. The gray iron material has a graphite flake structure which provides good wear and toughness characteristics. The gray iron liners are typically heat treated by either a quench and tempering process or induction hardening. The quench and temper heat treatment produces a through-hardened martensitic microstructure in which the graphite flakes are dispersed. Induction hardening involves locally heating the inner wall surface of the liners followed by a rapid quenching to provide a case hardened skin that has primarily a martensitic microstructure in which the graphite flakes are dispersed.

For many engine applications, such heat treated gray iron liners exhibit sufficient strength and wear properties to provide good service. However, recent advancements in diesel engine performance has placed ever-increasing demands on the liners, and the demands of next generation diesel engines are expected to continue to a point where the conventional gray iron liners may not provide adequate services. The increased efficiency and power of the engines exposes the liner to higher and higher operating temperatures and pressures beyond the limits for which these traditional liners were designed to operate under. In addition to exhibiting acceptable levels of strength and wear properties, the liners for such engines must also exhibit good dimensional stability. When heated to an elevated operating temperature, the liners naturally undergo a certain amount of thermal expansion, which is recoverable once the liners cool. However, if the operating temperatures are high enough and the exposure time long enough, such liners can undergo phase transformations of the material which result in permanent irrecoverable thermal growth particularly near the upper end of the liners which are directly exposed to the combustion environment. In designing a liner for a given engine application, such anticipated thermal expansion and thermal growth must be accounted for. While good performance of the engine calls for a close fit between the liner and block, a high level of thermal growth requires adequate space for the growth of the material. Since closely fit liners are often restricted by the block against radially outward movements, the liners are caused to grow inwardly, reducing the diameter of the inner wall against which the piston runs. Under such conditions, the piston rings and shaft can wear prematurely as can the liner. Such anticipated growth "shrinkage" of the inner running surface of the liners would have to be accounted for in designing an engine, and thus the inner diameter of the liners would have to be sufficiently oversized, which is counterproductive to engine performance under normal operating conditions before such extreme conditions are encountered.

One known approach to addressing the problems associated with traditional liners in high performance applications has been to control the solidification of the gray iron during casting in such manner as to achieve an as-cast bainitic microstructure. While such a liner exhibits good strength, wear and dimensional stability under the extreme operating conditions, such critical control over the casting operation adds cost and complexity to the manufacture of cylinder liners.

Cylinder liners constructed according to the invention overcome or minimize the limitations of the conventional gray iron liners.

SUMMARY OF THE INVENTION

A method of making a cylinder liner according to the invention includes first casting a cylinder liner structure from gray iron material and thereafter austempering the liner to develop a bainitic microstructure.

According to a further preferred feature of the invention, the cylinder liner structure is maintained at the austempering temperature during heat treatment for a time sufficient to develop a dimensionally stable bainitic microstructure that exhibits a comparably low, acceptable level of thermal growth when exposed to extreme operating conditions of 450° F. operating temperature for 20 hours.

According to still a further preferred aspect of the invention, the cast gray iron liner structure is maintained at the austempering temperature for at least about 5 hours to achieve a coefficient of thermal growth of less than about $0.3\times10^{-6}$ in/in° F. at 450° F.

Austempered gray iron cylinder liners constructed according to the invention have the advantage of exhibiting good strength and wear characteristics along with excellent thermal growth properties, making such liners well suited for the next generation high temperature, high performance engine applications.

The invention has the further advantage of achieving such properties by utilizing conventional low cost casting technologies coupled with controlled austemper heat treatment. There is no need to take such special care during casting to develop a particular as-cast microstructure. During the austempering heat treatment cycle, the cast liner structure is first heated to an elevated temperature to austentize the material and thereafter quenched to the austempering temperature at a rate and for a time sufficient to develop the desired dimensionally stable low thermal growth bainitic microstructure.

BRIEF DESCRIPTION OF THE DRAWINGS

These and other features and advantages of the present invention will become more readily appreciated when considered in connection with the following detailed description and appended drawings, wherein:

FIG. 1 is a schematic perspective view of a cylinder liner constructed according to the invention;

FIG. 2 is a schematic longitudinal cross-sectional view of an internal combustion engine having the liner of FIG. 1 installed therein;

DETAILED DESCRIPTION

Figure 3:
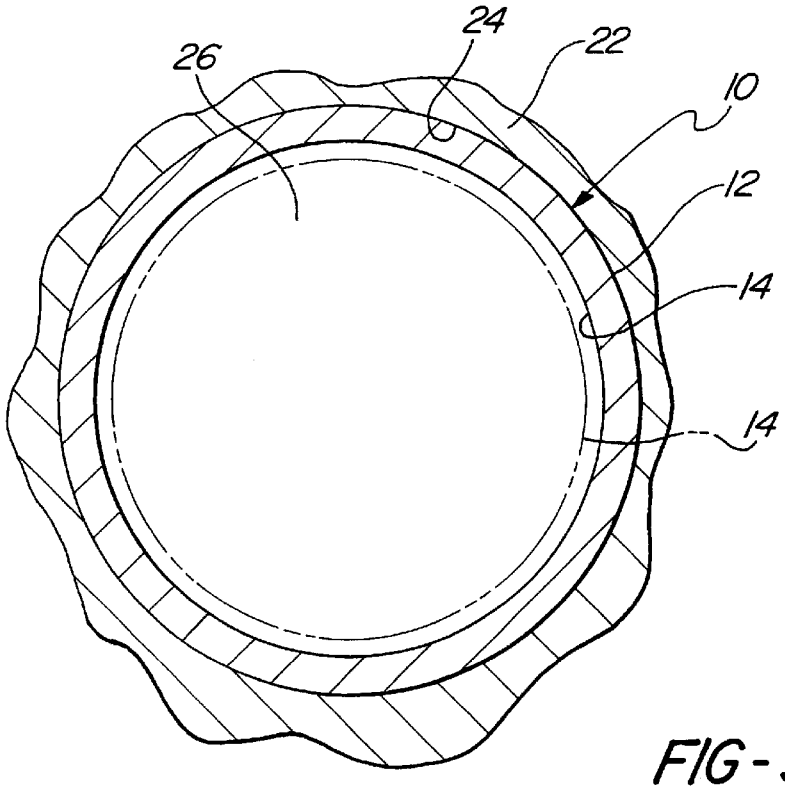
FIG. 3 is a schematic cross-sectional view of the liner taken generally along lines 3—3 of FIG. 2.

A cylinder liner or sleeve constructed according to a presently preferred embodiment of the invention is generally shown at 10 in FIGS. 1–3. The liner 10 has a generally cylindrical wall structure having a generally cylindrical outer surface 12, and a substantially cylindrical inner cylinder wall running surface 14 and longitudinally opposite upper and lower ends 16,18 respectively.

FIG. 2 illustrates the liner 10 installed in an internal combustion engine 20, such as a high performance diesel engine. The engine 20 includes a block 22 having a plurality of bores 24 (one shown) in which the liners 10 are fitted. A waterjacket 25 surrounds the liner 10 (wet liner). The inner running surface 14 of the liner 10 defines a piston chamber 26 in which a piston assembly 28 of the engine reciprocates. The piston assembly 28 includes a piston body 30 having a upper crown or head 32 carrying a plurality of rings 34 disposed in running contact with the inner surface 14 of the liner 10. The piston assembly 28 further includes a piston skirt 36 adjacent the lower end of the piston assembly 28. The skirt 36 moves into contact with the wall 14 during operation to transfer side loads on the piston 28 in order to guide the piston 28 properly within the piston chamber 26. The liner 10 is removable from the block 22 to facilitate repair or replacement as needed.

The liner 10 constructed according to the invention exhibits good tensile and fatigue strength and good wear characteristics as well as low thermal growth characteristics under extreme operating conditions representative of what could be expected to be encountered in high performance linered engine applications. A standard for such conditions is acceptable thermal stability under a sustained operating temperature of 450° F. for 20 consecutive hours. Under such conditions, the strength and wear properties must not diminish significantly to a point where the liner 10 would not perform under the expected operating conditions. Moreover, the liner 10 must not undergo unacceptable thermal growth which would cause undue wear of the rings, skirt, or liner.

From experimental studies, it was surprisingly found that controlled austempering of a cast gray iron liner structure according to the invention provided the desired properties of good strength and wear while also imparting low thermal growth characteristics of the liner 10, making such liners suitable for use in next generation high performance, high temperature engines.

According to a presently preferred method of making such a liner 10, a cylinder liner structure is first cast from a heat treat hardenable grade of gray iron material, such as ASTM class 45. The cast liner structure is heat treated according to an austempering heat treat cycle to develop a substantially bainitic microstructure with retained graphite flakes that is sufficiently stable against thermal growth for the intended high performance engine applications.

Acceptable thermal stability is defined as the growth behavior of the liner structure when heated to a given operating temperature of 450° F. for 20 hours. For every inch of outer diameter of the liner heated to the given temperature, the liner 10 should grow in diameter no more than about $0.3\times10^{-6}$ in. For example, a 4 inch liner heated to 450° F. for 20 hours and then cooled to pm ambient temperature should experience thermal growth of no more than about $(0.3\times10^{-6}\cdot4\cdot450)$, or $540\times10^{-6}$ inches, according to the formula $D_{TG=KG}\cdot D_O\cdot T$, where $D_{TG}$ is the permanent thermal growth of the liner in inches, $D_O$ is the original outer diameter of the liner in inches, T is the operating temperature in ° F. for 20 hours, and $K_G$ is the coefficient of thermal growth in in/in° F. Expressed another way, the allowable maximum thermal growth in diameter for a liner of a given starting diameter heated to 450° F. for 20 hours and then cooled to ambient temperature is about 135×106 inches growth/inches of original diameter (in/in). It is to be understood that "thermal growth" is a change in dimension separate from and in addition to thermal expansion. Whereas "thermal expansion" is temperature dependent and reversible, "thermal growth" is not. Thermal growth is time and temperature dependent and non-reversible.

Figure 4:
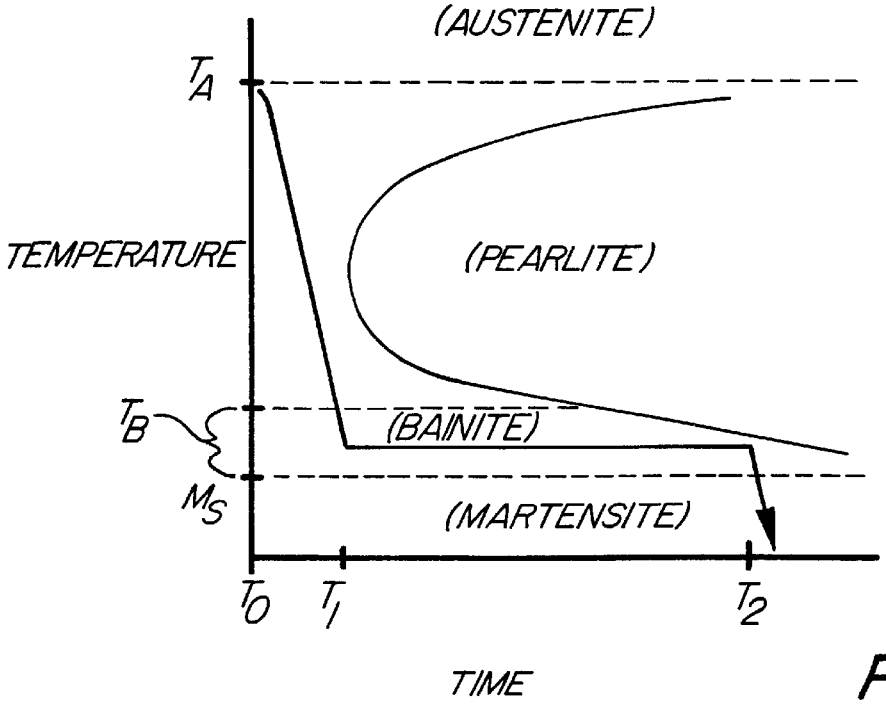
FIG. 4 is a representative TTT curve of the austemper heat cycle.
Figure 5:
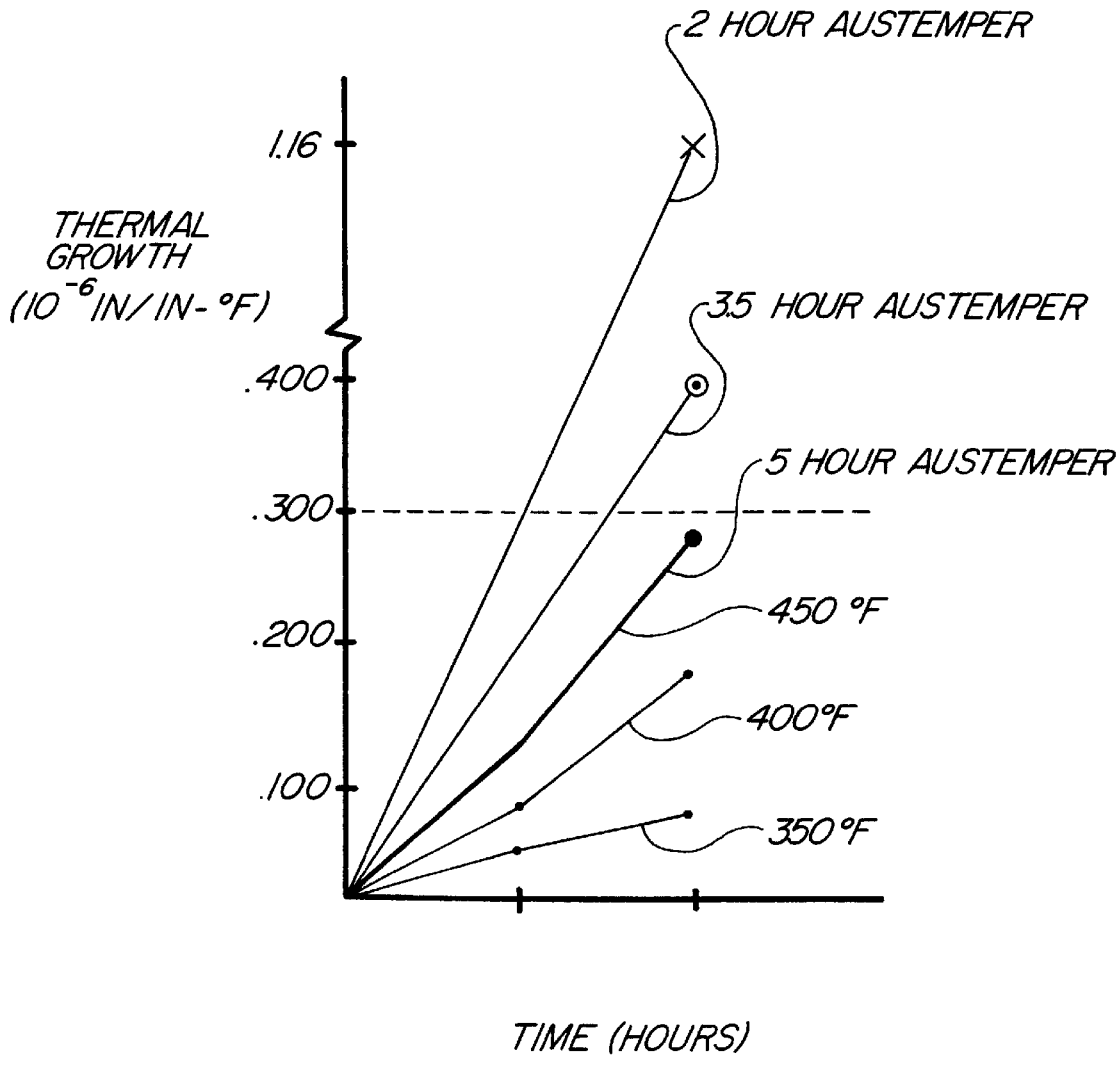
FIG. 5 is graphic illustrating the effect of controlled austempering on the coefficient of thermal growth properties of gray iron liner materials.

Referring to the graph of FIG. 4 and to the TTT heat treat cycle of FIG. 5, tests were conducted on different gray iron liner material samples to measure the effect of the austemper heat treatment on the resultant coefficient of thermal growth of the liner samples. The samples were cast from ASTM class 45 gray iron having alloy additions of Cu, Ni and Mo following which they were austempered for different time periods. The samples were initially heated to an elevated austenizing temperature $T_A$ of about 1600° F. for about 1 to 1½ hours in a molten salt bath in order to austentize the material but without destroying the graphite flake structure. The material samples were then removed from the bath at $t_0$ and immediately quenched within time $t_1$ in a second molten salt bath maintained at a temperature within the austempering range $T_B$ of about 650° F. The rate of cooling $(t_0–t_1)$ was controlled to substantially avoid the nose of the TTT curve (FIG. 5) and thus the formation of pearlite. The austempering temperature $T_B$ of the quench bath is held above the martensite start temperature $M_S$ to substantially avoid the formation of martensite upon initial quenching and during transformation at the austempering temperature $T_B$.

The liner samples of FIG. 5 were isothermally transformed at the austempering temperature $T_B$ for the set times $t_1–t_2$ to achieve the desired bainitic microstructure and thermal growth stability. The preferred liner specimen was held for about 5 hours at $T_B$. Sample 1 of FIG. 4 represents a cast gray iron liner sample austempered for about 2 hours. It has a $K_G$ of 1.16 in/in° F. Sample 2 represents a cast gray iron liner sample, which was austempered for about 3.5 hours. It has a $K_G$ of about 0.375 in/in° F. It has been found that for next generation high performance engine applications, a $K_G$ of less than about 0.3 in/in° F. is needed to preclude unacceptable levels of thermal growth during operation.

Sample 3 of FIG. 4 represents a liner sample which was austempered at $T_B$ for about 5 hours. It has a $K_G$ of about 0.219 $\mu$ in/in° F. It will thus be seen that by controlling the austempering time, the coefficient of thermal growth of cast gray iron can be controlled. While the reason for the thermal growth and the stability of growth through controlled austempering is not entirely understood, it is believed that a certain amount of retained austenite may be converted to bainite or perhaps a more thermally stable form of austenite, such that at the prolonged elevated operating temperatures, transformation of the microstructure to a greater volume phase is controlled to within acceptable limits. Studies thus showed that the 5 hour austempering cycle has the surprising positive effect of stabilizing the thermal growth of cast gray iron by possibly transforming an otherwise troublesome percentage of retained austenite or other unstable phase to a more stable form of austenite or bainite, avoiding the formation of excessive pearlitic phases, or greater volume austenite phases, which would contribute to the thermal growth of the material.

While ASTM class 45 is the preferred gray iron alloy, the use of other austemper heat-treatable grades of gray iron alloys is contemplated and the results would expect to be similar. Of course, the time at the austempering temperature required to develop the thermal growth stability may vary depending upon the particular gray iron alloy used. Such variations are contemplated by the invention.

FIG. 3 represents a liner 10 heat treated according to the invention before and after being exposed to the 20 hour extreme temperature operating environment at 450° F. As mentioned previously, the liner 10 when installed will likely be restrained on its outer surface 12 by the block 22, particularly in the vicinity of the upper end of the liner, causing any thermal growth to occur radially inwardly. The solid line of the inner wall 14 represents the original diameter of the liner before exposure. The smaller diameter broken chain line represents the reduction in the inner wall diameter due to the thermal growth of the material as a result of the exposure. The difference in the diameter represents the thermal growth. The amount of thermal growth will depend on the diameter of the liner, with liners of greater diameter experiencing more growth. Normalized, the coefficient of thermal growth, $K_G$ represents the material characteristic that can be applied to a liner of a given starting diameter exposed to a given operating temperature for 20 hours to determine the expected thermal growth.

To calculate $K_G$ for a given liner, the starting outer diameter (if the liner is unrestrained or the inner diameter if the liner is restrained in a block) is measured in inches. The liner is subjected to a temperature of 450° F. for 20 hours and cooled. The diameter is again measured to determine the change in diameter due to thermal growth, and the change in diameter value divided by the product of the starting diameter and the 450° F. exposure temperature. The change in diameter measurements should be taken in those regions of the liner which are subjected to the most severe conditions, typically the upper end region of the liner exposed to the hot combustion gases.

The disclosed embodiment is representative of a presently preferred form of the invention, but is intended to be illustrative rather than definitive thereof. The invention is defined in the claims.

The disclosed embodiment is representative of a presently preferred form of the invention, but is intended to be illustrative rather than definitive thereof. The invention is defined in the claims.

What is claimed is:

1. A method of manufacturing a cylinder liner, comprising:

casting gray iron material to the shape of a solidified cylinder liner structure; and austempering the cylinder liner structure to develop a substantially bainitic microstructure.

2. The method of claim 1 wherein the austempering of the cylinder liner structure imparts a maximum thermal growth rate of $135\times10^{-6}$ in/in measured after the cylinder liner has been heated for 20 hours at a 450° F. and cooled to ambient temperature.

3. The method of claim 2 wherein the austempering of the cylinder liner structure includes heating the structure to an elevated temperature sufficient to austenitize the material and thereafter cooling the austenitized structure to an austempering temperature at a cooling rate and for a time sufficient to transform the austenitic microstructure substantially to bainite.

4. The method of claim 3 wherein the cylinder liner structure is maintained at the austempering temperature for at least about 5 hours.

5. The method of claim 3 wherein the cylinder liner structure is maintained at the austempering temperature for about 5 hours.

6. The method of claim 1 wherein the gray iron material is selected as ASTM class 45 grade of gray iron.

7. The method of claim 3 wherein the austempering temperature is selected to be about 650° F.

8. A method of manufacturing a cylinder liner comprising:

casting gray iron material to the shape of a solidified cylinder liner structure; and subjecting the cylinder liner to an austempering heat treat cycle including heating the cylinder liner structure to an elevated austenitizing temperature to develop an austenitic microstructure, and thereafter cooling the austenitized cylinder liner to an austempering temperature of about 650° F. and maintaining the cylinder liner structure at the austempering temperature for at least about 5 hours to develop a substantially bainitic microstructure and to stabilize the cylinder liner structure against excessive thermal growth when used in service by imparting a coefficient of thermal growth, $K_G$, of less than about $0.3\times10^{-6}$ in/in·° F. for a cylinder liner structure heated for 20 hours at 450° F.

9. A cylinder liner comprising:

a cast cylinder liner structure fabricated of gray iron material; and said liner structure being austempered to provide a substantially bainitic microstructure.

10. The liner of claim 9 wherein the austempered liner structure has a coefficient of thermal growth of less than about $0.3\times10^{-6}$ in/in° F.

11. The liner of claim 9 wherein the gray iron material comprises ASTM class 45 grade of gray iron.

* * * * *